US005659980A

United States Patent [19]

Lin

[11] Patent Number: 5,659,980

[45] Date of Patent: Aug. 26, 1997

[54] ADJUSTABLE SHOE

[76] Inventor: Ji-Tyan Lin, No. 52-258, Jong Yeong Road, Nan Twen Area, Taichung City, Taiwan

[21] Appl. No.: 687,176

[22] Filed: Jul. 29, 1996

[51] Int. Cl.[6] ..... A43B 3/28; A43B 3/26

[52] U.S. Cl. ..... 36/112; 36/105; 36/97

[58] Field of Search ..... 36/97, 112, 105, 36/100, 110, 101

[56] References Cited

U.S. PATENT DOCUMENTS

| | | | |
|---|---|---|---|
| 2,745,196 | 5/1956 | Schneider et al. | 36/112 X |
| 3,762,075 | 10/1973 | Munschy | 36/112 X |
| 4,120,103 | 10/1978 | Colby | 36/97 |
| 5,570,523 | 11/1996 | Lin | 36/112 |

*Primary Examiner*—Ted Kavanaugh

*Attorney, Agent, or Firm*—Beveridge, DeGrandi, Weilacher & Young, L.L.P.

[57] ABSTRACT

An adjustable shoe has a heel, a toecap and an insole. The front portion of an instep has a plurality of positioning protrusions. The first and second fastening pads are disposed on two outer sides of the heel. The first and second ball buttons are disposed on the rear surface of the heel. An adjustable pad with positioning holes thereon is disposed on the toecap. Two flaps are extended upward from the toecap. The inner surface of the flap has a fastening element. The first and second positioning plates are extended from the back of the outsole. The first positioning plate has the first socket button. The second positioning plate has the second socket button.

1 Claim, 3 Drawing Sheets

36
361
362
271
27
2
25
21
211
26
335'
335
31
311
A B C D
4
34
3
3351'
3351
33

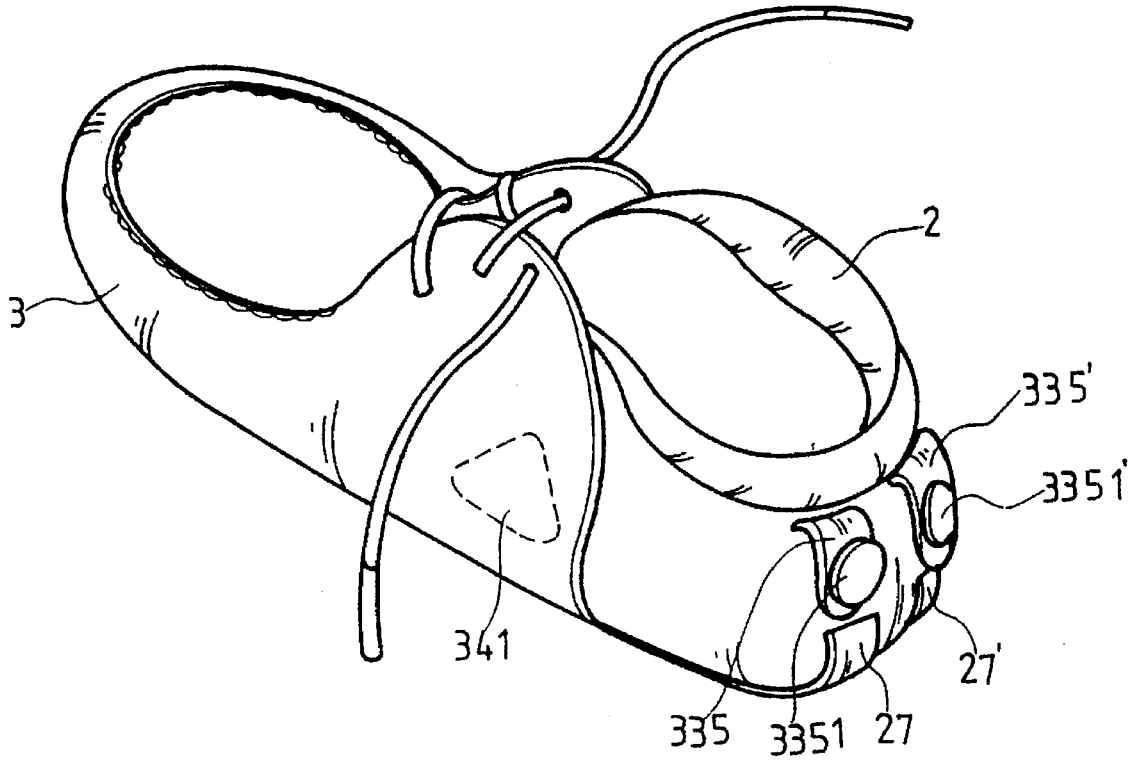
FIG 2
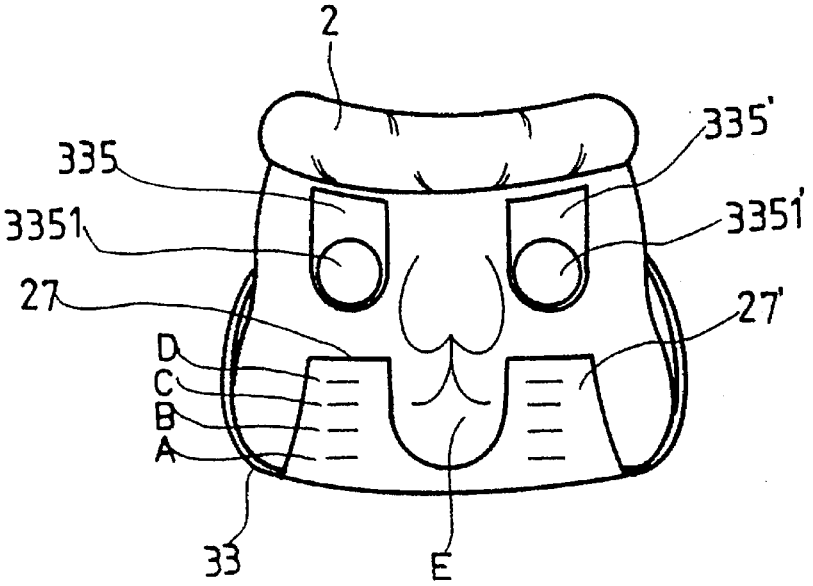
FIG 1 -B

ADJUSTABLE SHOE

BACKGROUND OF THE INVENTION

The present invention relates to an adjustable shoe. More particularly, the present invention relates to an adjustable shoe which can be adjusted to a predetermined size.

Most shoes cannot be adjusted to a predetermined size. The feet of a child are often grown up very fast. Therefore, the children's shoes often become too short after a period of usage. The short shoes may deform the shapes of the toes and feet. Furthermore, the short shoes may obstruct the normal growth of the children. If the children's shoes are too large for the children, the children will feel very uncomfortable while walking. When the children are walking on the rough roads or climbing the staircases, the large shoes may stumble the children easily. Thus it is necessary to provide adjustable shoes for the children. The adjustable shoes should be adjusted according to the sizes of the feet of the children. Furthermore, the adjustable shoe should be fixed to a predetermined size after it is adjusted.

SUMMARY OF THE INVENTION

An object of the present invention is to provide an adjustable shoe which contains a plurality of fastening elements in order to adjust the length of the adjustable shoe.

Another object of the present invention is to provide an adjustable shoe which can be adjusted to a predetermined size so that the user can feel comfortable for a longer period.

Accordingly, an adjustable shoe comprises a heel, a toecap and an insole. A front portion of an instep has a plurality of positioning protrusions. A first and second fastening pads are disposed on two outer sides of the heel. A first and second recesses are formed on a rear surface of the heel. A first and second ball buttons are disposed on the rear surface of the heel. An adjustable pad which has a positioning seat disposed on the adjustable pad is disposed on the toecap. A strap with a plurality of positioning holes thereon is disposed on the positioning seat. A first and second positioning plates are extended from a rear portion of an outsole. The first positioning plate has the first socket button. The second positioning plate has the second socket button. Two flaps are extended upward from the toecap. The inner surface of the flap has a fastening element. The insole is made of soft material. The insole can cover the whole surface of the adjustable pad.

Wherein the positioning protrusions are inserted into the corresponding positioning holes. The first and second positioning plates enclose the first and second recesses, respectively. The first and second socket buttons are snapped with the first and second ball buttons, respectively. Thus the adjustable shoe is in the smallest size.

Wherein the heel is detached from the shoe via departing the positioning protrusions from the positioning holes. The heel is moved rearward to match the size of the foot. The positioning protrusions are inserted in the positioning holes. Then the insole is placed in the shoe. The first and second socket buttons are snapped with the first and second ball buttons, respectively. Thus the adjustable shoe is in a larger size.

BRIEF DESCRIPTION OF THE DRAWINGS

FIG. 1B is a rear elevational view of a heel of FIG. 1;

FIG. 2 is a perspective assembly view of FIG. 1;

DETAILED DESCRIPTION OF THE INVENTION

Figures 1, 1A, 1C:
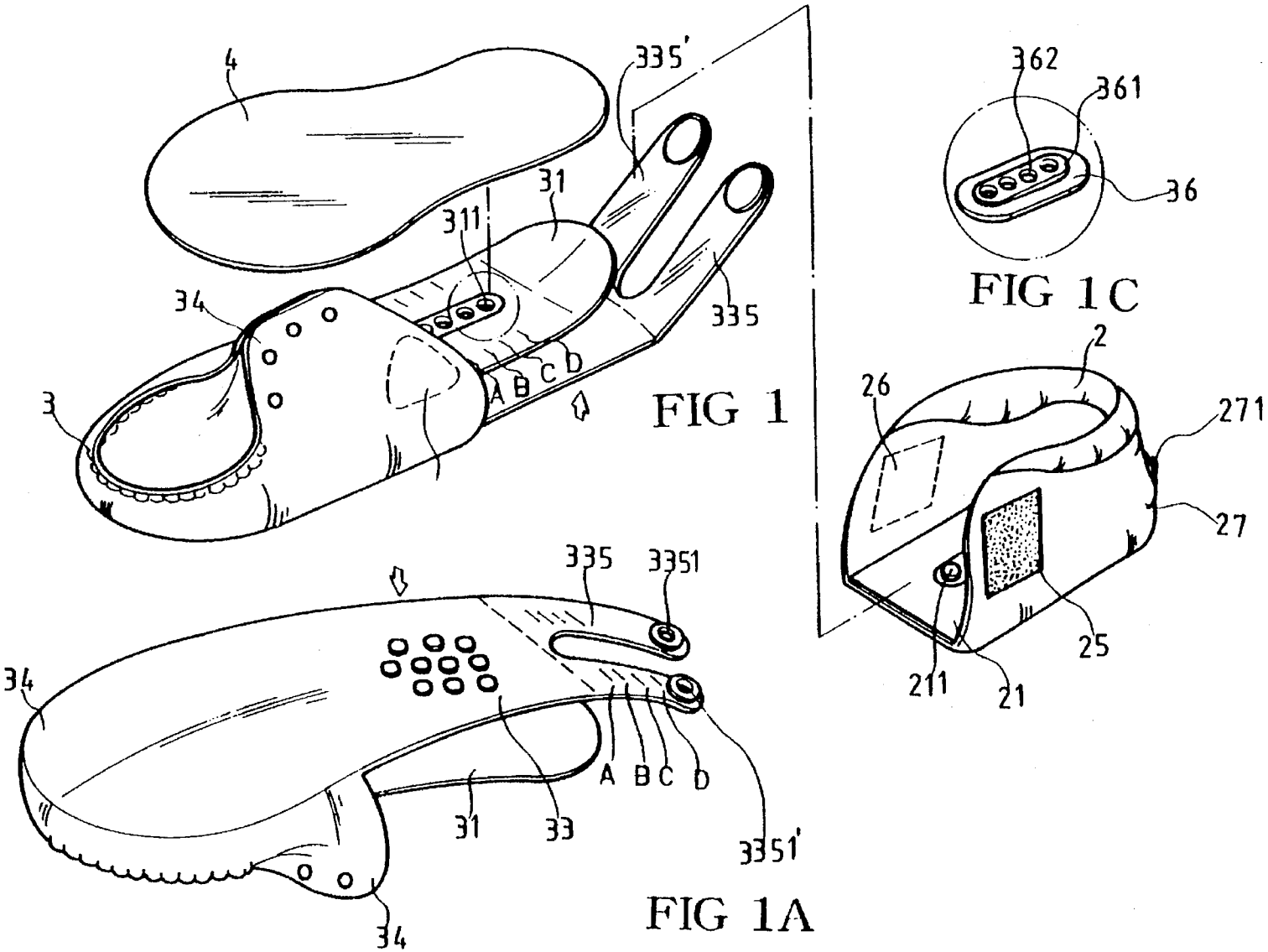
FIG. 1 is a perspective exploded view of an adjustable shoe of a preferred embodiment in accordance with the present invention.
FIG. 1A is a bottom view of a toecap of FIG. 1.
FIG. 1C is a perspective view of a positioning seat.
Figure 4:
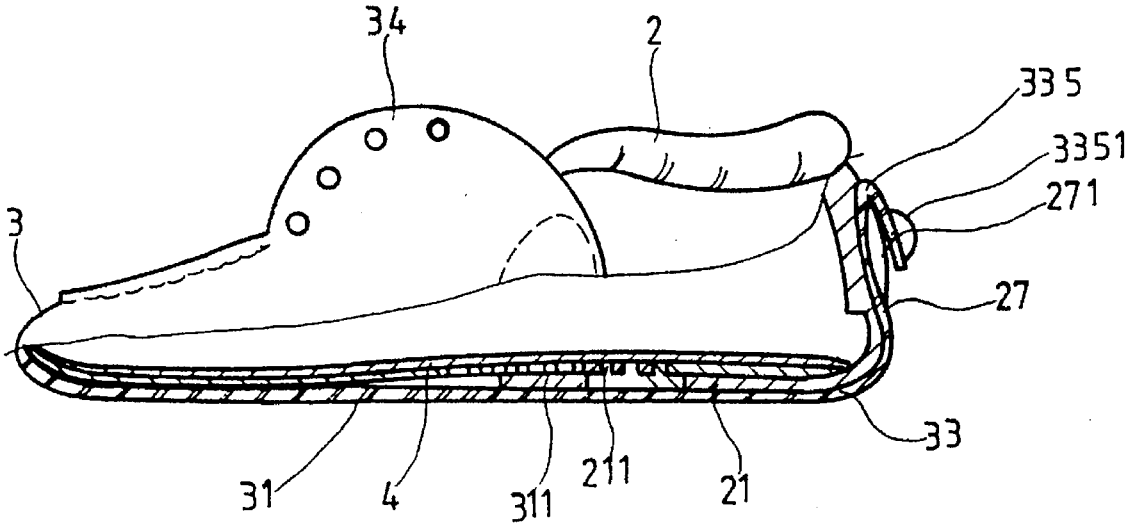
FIG. 4 is a schematic view of FIG. 1 illustrating the largest size of an adjustable shoe.

Referring to FIGS. 1, 1A, 1B, and 2, an adjustable shoe has a heel 2, a toecap 3 and an insole 4. A front portion of an instep 21 has a plurality of positioning protrusions 211. A first and second fastening pads 25 and 26 are disposed on two outer sides of the heel 2. A first and second recesses 27 and 27' are formed on a rear surface of the heel 2. A first and second ball buttons 271 and 271' are disposed on the rear surface of the heel 2. An adjustable pad 31 which has a plurality of positioning holes 311 thereon is disposed on the toecap 3. A first and second positioning plates 335 and 335' are extended from a rear portion of an outsole 33. The first positioning plate 335 has the first socket button 3351. The second positioning plate 335' has the second socket button 3351'. Two flaps 34 are extended upward from the toecap 3. The inner surface of the flap 34 has a fastening element 341. The insole 4 is made of soft material. The insole 4 can cover the whole surface of the adjustable pad 31.

Referring to FIG. 1C, a positioning seat 36 is disposed on the adjustable pad 31. A strap 361 with a plurality of positioning holes 362 thereon is disposed on the positioning seat 36.

Figure 3:
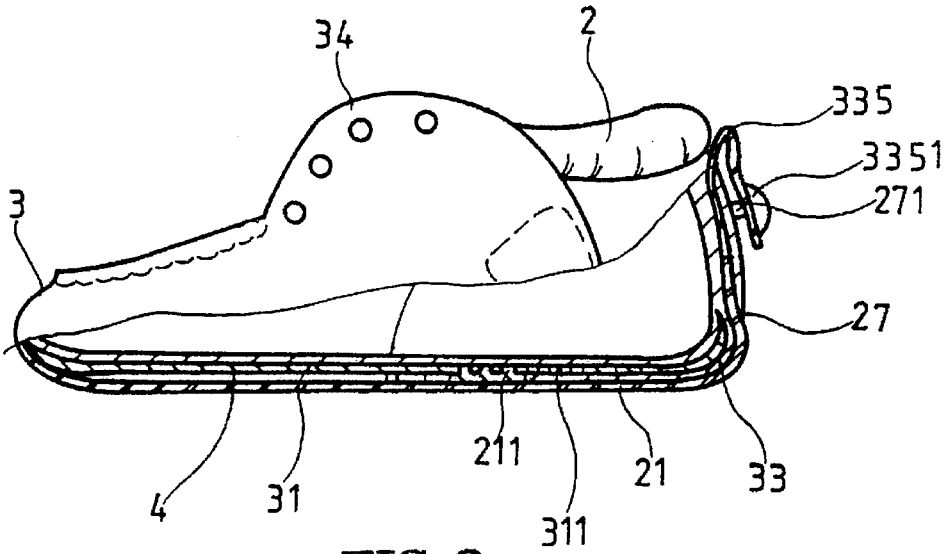
FIG. 3 is a schematic view of FIG. 1 illustrating the smallest size of an adjustable shoe.

Referring to FIGS. 1 to 3 again, the positioning protrusions 211 are inserted into the corresponding positioning holes 311 or 362. The first and second positioning plates 335 and 335' enclose the first and second recesses 27 and 27', respectively. The first and second socket buttons 3351 and 3351' are snapped with the first and second ball buttons 271 and 271', respectively. Thus the adjustable shoe is in the smallest size.

Referring to FIGS. 1 to 4, the insole 4 is removed. The user can detach the heel 2 from the shoe via departing the positioning protrusions 211 from the positioning holes 311 or 362. The heel 2 is moved rearward to match the size of the foot. The positioning protrusions 211 are inserted in the positioning holes 311 or 362. Then the insole 4 is placed in the shoe. The first and second socket buttons 3351 and 3351' are snapped With the first and second ball buttons 271 and 271', respectively. Thus the adjustable shoe is in a larger size.

The marks A, B, C and D on the adjustable pad 31 match the corresponding positioning holes 311 or 362 to indicate the positions of the positioning holes 311 or 362 The marks A', B', C' and D' on the corresponding positioning plate 335 or 335' indicate the folding positions of the corresponding positioning plate 335 or 335'. A pattern E is formed on a rear surface of the heel 2.

The present invention is not limited to the above embodiments but various modification thereof may be made. It will be understood by those skilled in the art that various changes in form and detail may be made without departing from the scope of the present invention.

I claim:

1. An adjustable shoe comprises a heel, a toecap and an insole, the improvement wherein:

a front portion of an instep has a plurality of positioning protrusions, a first and second fastening pads are disposed on two outer sides of the heel, a first and second recesses are formed on a rear surface of the heel, a first and second ball buttons are disposed on the rear surface of the heel, an adjustable pad which has a positioning seat disposed on the adjustable pad is disposed on the toecap, a strap with a plurality of positioning holes thereon is disposed on the positioning seat, a first and second positioning plates are extended from a rear portion of an outsole, the first positioning plate has a first socket button, the second positioning plate has a second socket button, two flaps are extended upward from the toecap, an inner surface of each of the flaps has a fastening element, the insole covers a whole surface of the adjustable pad, the positioning protrusions are inserted into the corresponding positioning holes, the first and second positioning plates enclose the first and second recesses respectively, the first and second socket buttons are snapped with the first and second ball buttons respectively to adjust the adjustable shoe into a small size, the heel is detached from the shoe via departing the positioning protrusions from the positioning holes, the heel is moved rearward to match a size of the foot, the positioning protrusions are inserted in the corresponding positioning holes, the insole is placed in the shoe, the first and second socket buttons are snapped with the first and second ball buttons respectively to adjust the adjustable shoe into a large size.

* * * * *